US005269651A

United States Patent [19]

Ostermeir et al.

[11] Patent Number: 5,269,651

[45] Date of Patent: Dec. 14, 1993

[54] GUIDE VANE RING OF A TURBINE OF A GAS TURBINE ENGINE

[75] Inventors: Oskar Ostermeir, Kottgeisering; Wolfgang Krüger, Reichertshausen, both of Fed. Rep. of Germany

[73] Assignee: MTU Motoren- Und Turbinen-Union Munchen GmbH, Fed. Rep. of Germany

[21] Appl. No.: 809,546

[22] PCT Filed: May 28, 1991

[86] PCT No.: PCT/DE91/00458

§ 371 Date: Jan. 30, 1992

§ 102(e) Date: Jan. 30, 1992

[87] PCT Pub. No.: WO91/19078

PCT Pub. Date: Dec. 12, 1991

[30] Foreign Application Priority Data

Jun. 2, 1990 [DE] Fed. Rep. of Germany ..... 4017861

[51] Int. Cl.[5] ..... F01D 1/02

[52] U.S. Cl. ..... 415/209.1; 415/177; 415/134; 415/135; 415/136; 415/137; 415/138; 415/139; 415/173.3

[58] Field of Search ..... 415/209.1, 231, 173.1, 415/173.3, 134, 135, 136, 137, 138, 139, 177, 200, 566; 566/566

[56] References Cited

U.S. PATENT DOCUMENTS

| | | | |
|---|---|---|---|
| 507,468 | 10/1893 | White | 415/173.3 X |
| 3,843,279 | 10/1974 | Crossley et al. | 415/138 X |
| 3,857,649 | 12/1974 | Schaller et al. | 415/137 X |
| 3,992,127 | 11/1976 | Booher, Jr. et al. | 415/136 |
| 4,553,901 | 11/1985 | Laurello | 415/138 |
| 4,576,548 | 3/1986 | Smed et al. | 415/137 |
| 4,623,298 | 11/1986 | Hallinger et al. | 415/139 |
| 4,768,924 | 9/1988 | Carrier et al. | 415/138 X |
| 4,826,397 | 5/1989 | Shook et al. | 415/136 X |
| 4,897,021 | 1/1990 | Chaplin et al. | 415/139 X |

FOREIGN PATENT DOCUMENTS

| | | |
|---|---|---|
| 1928182 | 1/1970 | Fed. Rep. of Germany . |
| 3738439 | 3/1989 | Fed. Rep. of Germany . |
| 216737 | 6/1924 | United Kingdom . |
| 786689 | 11/1957 | United Kingdom . |

*Primary Examiner*—Edward K. Look
*Assistant Examiner*—Todd Mattingly
*Attorney, Agent, or Firm*—Evenson, McKeown, Edwards & Lenahan

[57] ABSTRACT

A guide vane ring having guide vanes is provided on two rings which are arranged coaxially and radially at a distance from one another. These two rings are held on assigned housing sections which are subjected to thermally different expansions. One ring is rigidly connected with the guide vanes, and the other ring is connected with the free ends of the guide vanes by the compressive force of a tensioning element. In addition, the other ring is divided into several piston-ring-type elements which axially follow one another and which are each slotted approximately axially and form a cylindrical sliding surface for the whole free ends of the vanes. The tensioning element is arranged on the one group of assigned housing sections while forming a radial compressive force distributed uniformly on the elements.

14 Claims, 3 Drawing Sheets

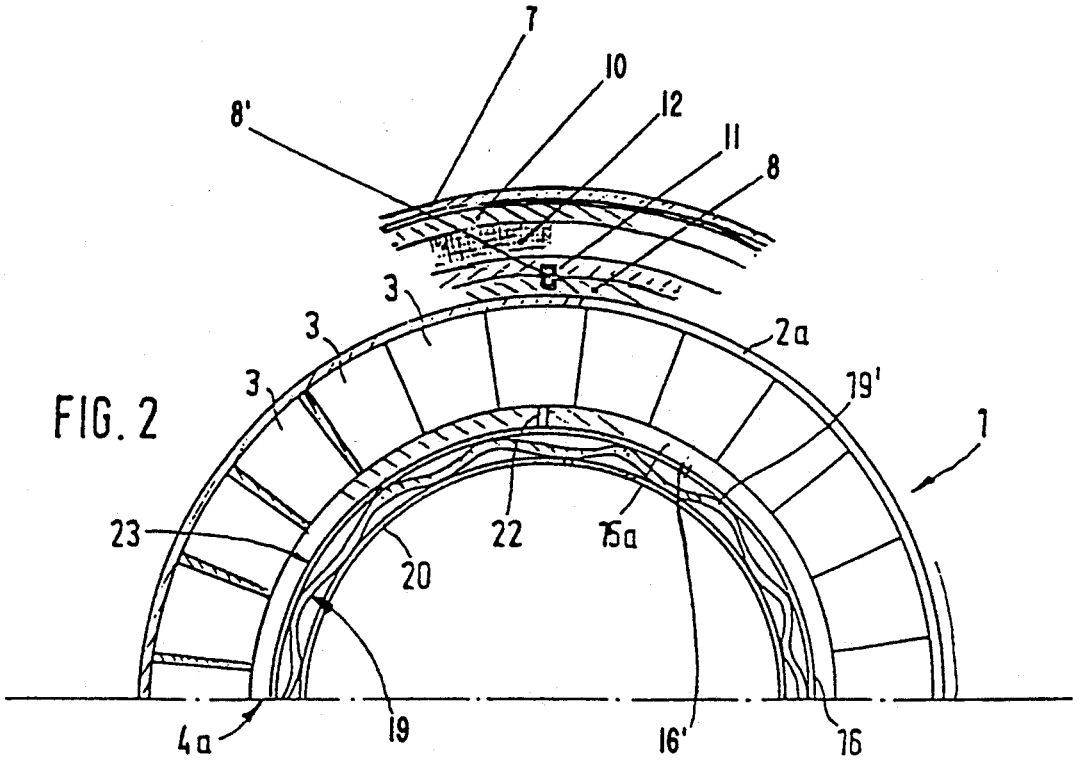
FIG. 2
FIG. 2a
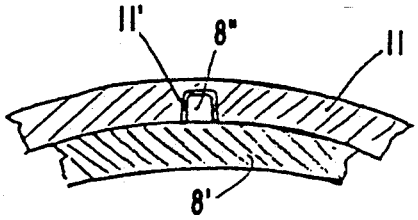

GUIDE VANE RING OF A TURBINE OF A GAS TURBINE ENGINE

BACKGROUND AND SUMMARY OF THE INVENTION

The invention relates to a guide vane ring of a gas turbine engine having guide vanes arranged on two rings which are coaxially and radially at a distance from one another and which are held on assigned housing sections which are exposed to thermally different expansions. One ring is rigidly connected with the guide vanes and the other ring is connected by the compressive force of a tensioning element with free ends of the guide vanes.

A guide vane ring of this type is known from the German Patent Document DE-PS 37 38 439. This is a so-called "semi-integral guide vane ring" in which case either one ring (outer ring) or the other ring (inner ring) is manufactured separately from the vanes and is not a direct fixed component of the guide grid. This type of guide vane ring is used in a gas turbine, preferably in the high-pressure turbine. Because of the high temperature differences occurring there, the guide vane rings expand which results in significant displacements in the radial direction. In addition, axial displacements occur because of the different thermal expansions between the inner and the outer housing which must be mastered for a guide vane ring which is connected with both housings by way of the corresponding rings in order to prevent distortions or even breakage of components.

An integral guide vane ring, i.e., a guide vane ring which is rigidly connected with both rings (that is the outer ring and the inner ring) in this case, would be subjected to considerable thermal tensions. For this reason, the "semi-integral construction" is to be preferred in this case. A problem in the case of a semi-integral guide vane ring are the leakages which occur between the free vane ends and the separate ring.

In the mentioned known case, the separate or other ring and the one ring fixed to the guide vanes are to be arranged to be axially displaceable and are to be pressed against one another by means of a tensioning element. The disadvantage of this arrangement is the fact that, in addition to the mentioned leakages, relatively expensive guiding devices must be provided for the axially movable part, in which case extremely different component temperatures and expansions present problems with respect to the required precise guiding.

It is an object of the present invention to provide a guide vane ring of the mentioned type which, on the one hand, does not impair the axial relative displacements and, on the other hand, drastically minimizes leakages between the free vane ends and the separate sealing ring and can be implemented by means of devices which constructively are as simple as possible.

According to the invention, this object is achieved by a guide vane ring of a turbine of a gas turbine engine having guide vanes arranged on two rings, which are arranged coaxially and radiallly at a distance from one another and which are held on assigned housing sections. The housing sections are exposed to thermally different expansions. One ring is rigidly connected with the guide vanes, and the other ring is connected by the compressive force of a tensioning element with free ends of the guide vanes. The other ring is divided into several piston-ring-type elements which follow one another axially and which are each slotted approximately axially and form a cylindrical sliding surface on which the guide vanes are axially displaceably disposed with their whole free ends. The tensioning element is arranged on the one group of assigned housing sections while forming a radial compressive force which is uniformly distributed on the elements.

The principal advantages of the invention are that the axial relative displacements between the outer and the inner housing or the corresponding sections of these housings and the one ring and the other ring (outer and inner ring) which are respectively connected with it, can be compensated completely in that the free vane tips can slide on the slotted piston-ring-type elements. At least two ring elements, which are arranged axially behind one another, in this case, form a cylindrical sliding surface for the vane tips so that thermally caused relative displacements in the axial direction are possible in an unimpaired manner.

In this context, "Axially slotted" means that a ring element, similar to a piston ring of a reciprocating engine, is interrupted at one point so that certain deformations of the ring element are possible while changing the gap width in the circumferential direction. Preferably the gap of a ring element according to the invention, in the cold state, is approximately 1–5 mm, and particularly 2–3 mm. The size and the shape in the individual case depends on the geometries, materials and temperatures.

The slotted ring elements are arranged such that the axial gaps of the rings are situated in an offset manner with respect to one another in the circumferential direction. Advantageously, only slight leakages will still occur between the gap and the vane tip or tips situated in this area. Gap flows from the delivery side to the intake side through such a gap can be avoided when the "approximately" axial gap of an element is not purely aligned axially but approximately in parallel to the flow direction in the guide vane ring, that is, at an angle with respect to the direction of the axis.

The construction according to the invention may also be used in the case of a radially outer or radially inner ring which is held separate with respect to the vanes.

The respective "other" ring, which, in each case, is not fixed to the vane, may comprise several, thus, for example, two, three or four piston-ring-type elements which are arranged axially behind one another. This has the advantage that the gaps are interrupted in the axial direction, and a possibly non uniform compressive force of the individual ring elements is distributed to several vanes.

The construction according to the invention is particularly suitable for ceramic components; i.e., the semi-integral guide vane ring is made of ceramic materials. In comparison to metallic materials, ceramics have multiple advantages, such as low wear because of the high hardness and high chemical stability; high dimensional stability in a wide temperature range; and arbitrary availability of raw materials. Preferably, the guide vane ring is manufactured of sintered silicon carbide (SSiC) because it maintains it flexural strength up to approximately 1,850K and is distinguished by low thermal expansion, high caloric conductibility, and high sensitivity to thermal shock. However, the guide vane ring or the guide vanes may also be made of metal, in which case protective layers against wear should be provided on the vane tips which rub with the slotted ring elements.

The guide vanes may be constructed to be massive (solid) or as hollow vanes.

The slotted ring elements are preferably made of $ZrO_2$ since this material, on the one hand, is distinguished by a low thermal conduction and, on the other hand, by a low modulus of elasticity, whereby the spring travel becomes longer than when, for example, SiC is used.

In an advantageous further development of the invention, the ring elements are arranged on a supporting ring which is also slotted in the axial direction and on which the tensioning element is supported. As a result, a defined position of the adjacent ring elements can be maintained and leakages can be minimized.

The tensioning element acts in the radial direction in order to, in this manner, press the slotted ring elements against the free vane tips. In this case, the tensioning element is designed as a spring ring which is corrugated in the circumferential direction. Constructively, this development is particularly simple. However, as an alternative, other constructions of the invention are also conceivable, such as single leaf springs or a metallic and thin-walled ring which can be acted upon by pressure on the interior side. In the case of a development as a spring ring, this spring ring is preferably arranged between a housing section of the flow duct and the supporting ring.

Another advantageous development of the invention for a ceramic guide vane ring provides that, between the one, for example, radially outer ring of the guide vane ring and the assigned housing sections, another spring element is provided. In particular, this is constructed as a metallic wire mesh. As a result, the one or radially outer ring with the molded-on guide vanes is centered in the radial direction in a thermally compatible manner, and the forces resulting from the radial displacements between the one radially outer ring and the housing are distributed evenly along the whole circumference, whereby the circumferential torque of the one radially outer ring, which results from the gas forces on the vanes, is elastically supported.

Other objects, advantages and novel features of the present invention will become apparent from the following detailed description of the invention when considered in conjunction with the accompanying drawings.

BRIEF DESCRIPTION OF THE DRAWINGS

FIGS. 2 and 2A are schematic views of the guide vane ring according to FIG. 1 in the axial direction, while omitting radially outer housing sections;

DETAILED DESCRIPTION OF THE DRAWINGS

Figure 1:
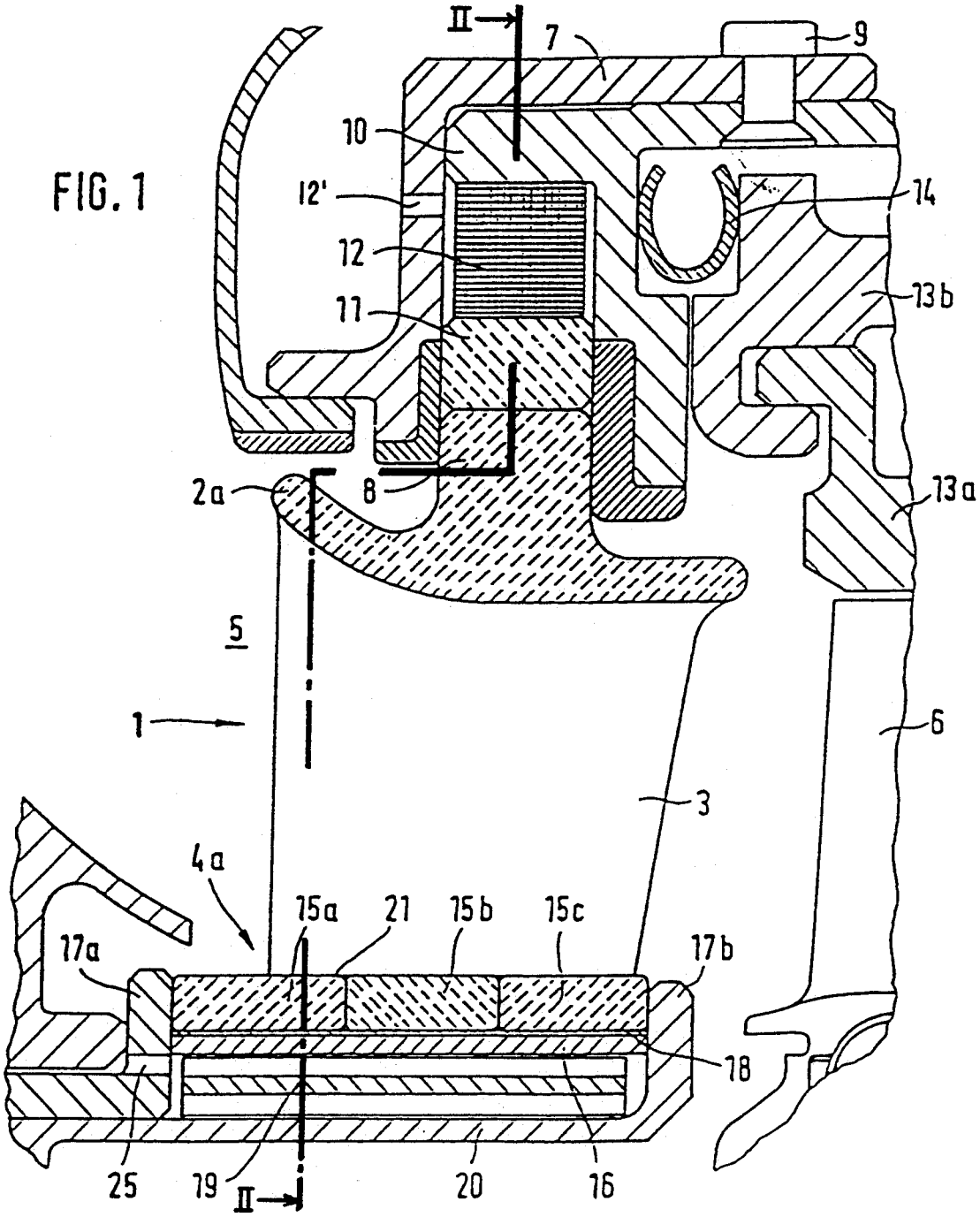
FIG. 1 is a central longitudinal sectional view of a guide vane ring of a turbine stage having guide vanes and moving vanes.

FIG. 1 illustrates a ceramic guide vane ring of a turbine stage of a gas turbine engine, which is not shown in detail. This ceramic guide vane ring 1 essentially comprises one radially outer ring 2*a* with guide vanes 3, which are rigidly molded onto it and are distributed along the circumference, and another radially inner ring 4*a* which is disposed on the vane ends. The guide vane ring 1 is arranged in a ring-shaped flow duct 5 upstream of the moving vanes 6 of the respective turbine stage. Via a circumferential web 8, the ring 2*a* is fixed radially in a circumferential groove in a thermally compatible manner. This circumferential groove is provided between the housing section 7 and another housing section 10 which is connected with it by means of rivets 9 and is constructed as a supporting ring 10. In the radial direction, the one ring 2*a* is held by a segmented ceramic insulating ring 11 and a wire mesh 12 arranged between the insulating ring 11 and the section 10. The wire mesh 12 is welded to both elements 10, 11. In order to transmit the circumferential torques, which act from the guide vanes 3 on the one ring 2*a*, by way of the web 8 to the insulating ring 11, naps 8″ (FIG. 2A) or the like, are provided between the insulating ring 11 and the web 8. The naps 8″ are steps which project radially on the web 8 and engage in recesses 11′ of the ring 11. For example, a feather-key-type member, 8′ (FIG. 2) which engages into corresponding axial grooves 11′ of the ring 11 and of the web 8 may also be provided. The feather-key-type member is a groove-tongue connection as shown in FIG. 2 embodied by spring 8′ or a plate between mutually open grooves on the web 8 and on the ring 11. The insulating ring 11 may be segmented in order to permit an elastic support of the radially exterior ring 2*a* for example. Among other things, as a development of a hook-type anchoring and development of an exterior shrouding for the moving vanes 6, additional housing elements 13*a* and 13*b* are provided, and a sealing ring downstream of the housing section 10 has the reference number 14. The other ring 4*a* according to this embodiment of the invention, which is arranged radially on the inside, comprises three ceramic piston-ring-type elements 15*a*, 15*b* and 15*c* which are arranged axially behind one another and are slotted in the axial direction. On one side, these are supported on a supporting ring 16 which is fitted in between two sections 17*a*, 17*b*, which are constructed as circumferential guiding flanges, of the radially interior housing. The supporting ring 16 is made, for example, of a metallic material, in which case advantageously a ceramic insulating layer 18 is applied to its outer circumference. In order to permit radial movements, the supporting ring 16 is also axially slotted 16.

A tensioning element 19 is situated between the supporting ring 16 and the one radially inner section 20 of the housing in order to apply a tensioning force to the supporting ring 16 which acts radially toward the outside so that the slotted piston-ring-type elements 15*a*, 15*b*, 15*c* are pressed against the outer free ends or vane tips 21 of the guide vanes 3, whereby, along the whole free vane length, a low-leakage connection is permitted between the tips 21 of the guide vanes 3 and the other ring 4*a*. In this case, the tensioning element 19 is constructed, for example, as a corrugated spring ring 19′. By way of a bore 25, cooling air is supplied to the tensioning element, for example from the compressor, in order to keep the metallic spring parts, particularly therefore the spring ring 19', at a low temperature and thus ensure a perfect elasticity for a comparatively long operating time.

FIG. 2 is an axial view taken along line II—II of FIG. 1 of the guide vane ring 1 according to the invention, showing the one radially outer ring 2*a*, the guide vanes 3 and the other ring 4*a* which is manufactured as a separate component of the guide vane ring 1. Of this ring 4*a*, the front-most of the rings 15 slotted in the axial direction is visible with its axial slot 22. In order to minimize leakage losses, the axial slots of the other slotted rings 15*b* and 15*c* (FIG. 1) are offset in the circumferential direction with respect to the axial slot 22. The ring 15*a* is disposed on the supporting ring 16 which also has an axial slot 23.

In the view according to FIG. 2, the construction of the tensioning element 19 constructed as a spring ring 19' is easily visible, in which case the spring ring 19', while being corrugated in the circumferential direction, extends between the supporting ring 16 and the section 20 of the radially interior housing.

Figure 3:
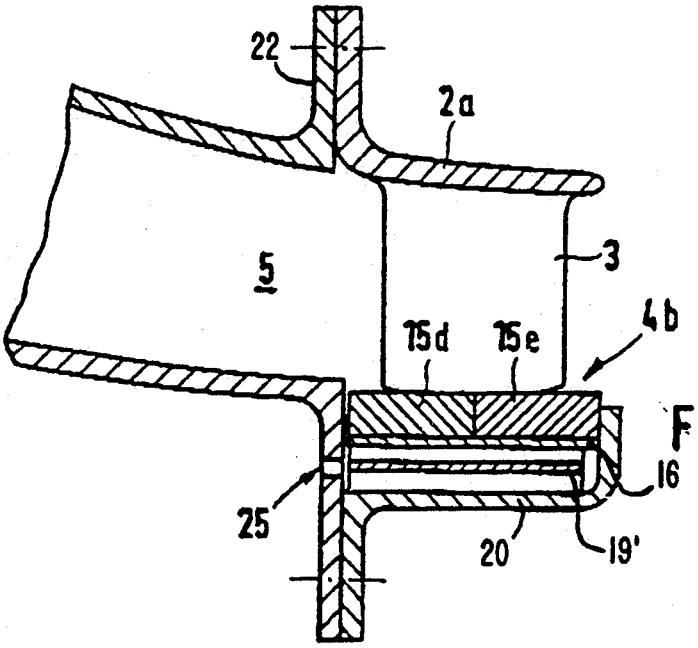
FIG. 3 is a view of an embodiment, which deviates from FIGS. 1 and 2 and has only two ring-shaped elements of the separate radially inner ring, the radially outer ring being directly rigidly connected with a housing section.
Figure 4:
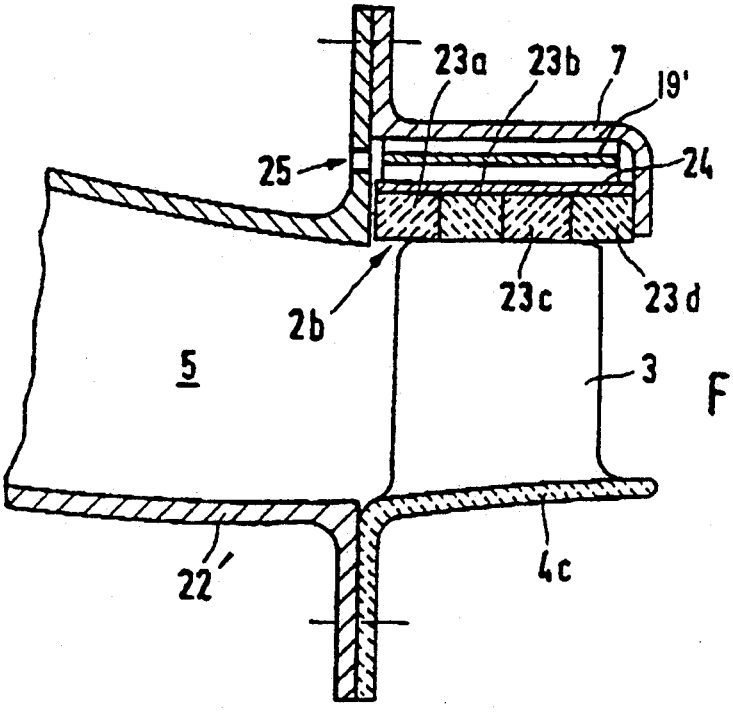
FIG. 4 is a view of an embodiment, which deviates from FIGS. 1 to 3, having a separate ring comprising four ring shaped elements and having one ring which is radially on the inside rigidly connected with the vanes and with a housing section.

FIGS. 3 and 4 show two additionally schematically represented embodiments of the invention. There, according to FIG. 3, the radially inner other ring 4*b* comprises only two slotted rings 15*d*, 15*e*, which are arranged axially behind one another and are manufactured, for example, of a metallic material. The spring ring, the radially inner one section of the housing and the supporting ring are provided according to FIG. 1 and have the reference numbers 19', 20 and 16. The radially outer one ring 2*a* is rigidly connected with the guide vanes 3 as well as directly rigidly with a radially outer wall section 22 of the housing for the flow duct 5.

In the case of the guide vane ring illustrated in FIG. 4, in contrast to the previously illustrated embodiments, the other radially outer ring 2*b* has several ring-shaped elements, while the guide vanes 3 are rigidly shaped onto the radially inner one ring 4*c*. This one ring 4*c* is directly rigidly connected with a radially inner wall section 22' of the housing for the flow duct 5. However, also in the case of this embodiment, an elastic construction may be used, similar to the wire mesh 12 shown in FIG. 1, on the side facing the one ring 4*c*.

The respective other ring 2*b*, in FIG. 4, comprises four piston-ring-type elements 23*a, b, c, d*, which are arranged behind one another and on the supporting ring 24. In this case, the tensioning element operates with the spring ring 19' between the supporting ring 24 and the corresponding radially outer section 7 of the housing.

It is, for example, also conceivable to construct the radially outer other ring 2*b* (FIG. 4) with only two slotted rings 23*a* and 23*b* without leaving the scope of the invention.

Figure 5:
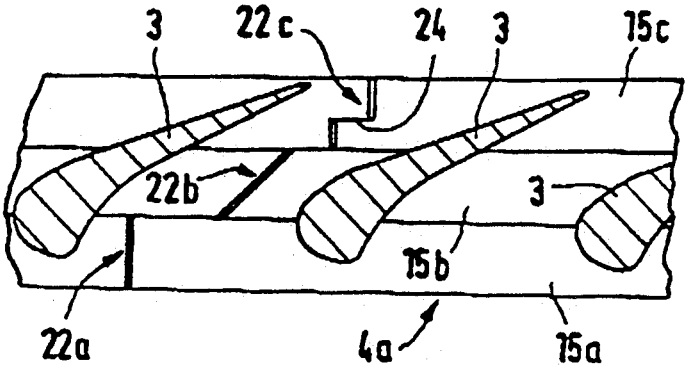
FIG. 5 is a top view of a section of the radially inner ring, which is divided into ring elements, on the guide vane ring according to FIG. 1.

FIG. 5 shows a number of guide vanes 3 which are disposed on the radially inner other ring 4*a* comprising three slotted piston-ring-type elements 15*a*, 15*b* and 15*c*. First, for purposes of demonstration, all axial slots 22*a*, 22*b* and 22*c* were turned into the shown area, while the slots should in fact preferably be uniformly distributed along the circumference and be arranged offset relative to one another. And secondly, three different embodiments of axial slots 22 are illustrated which are all comprised by the object of the invention. In practice, for reasons of simplification, the same slot configuration will expediently be used for all three ring elements 15*a*, 15*b* and 15*c*.

The axial slot 22*a* of the ring element 15*a* extends precisely in the axial direction. The axial slot 22*b* of the second ring element 15*b* is aligned at an angle to the axial direction, in which case, expediently, for minimizing flow losses, an angle is selected which corresponds approximately to the flow direction of the gas in this section of the guide vane ring; the slot shape 22*c* shown in the case of the third ring element 15*c* has a step-type shoulder 24.

It is advantageous to construct and arrange particularly the axial slot 22*b* of the center ring element 15*b* such that this axial slot 22*b* is completely covered by the end side or a tip of a guide vane 3 in order to prevent flow losses and leakages. This covering process can analogously also be applied to the other slots 22*a* and 22*c*.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A guide vane ring for a turbine of a gas turbine engine, having guide vanes arranged on two rings, the two rings being arranged coaxially and spaced apart radially from one another to define a gas flow channel, the two rings being further held on assigned housing sections exposed to thermally different expansions, one ring being rigidly connected to the guide vanes at one end and the other ring contacting the other free ends of the guide vanes by the compressive force of a tensioning element wherein said other ring is divided into several piston-ring-type elements arranged axially with respect to one another, said several piston-ring-type elements having approximately axial slots and forming a cylindrical sliding surface on which the guide vanes axially displaceably rest at their free ends, said tensioning element being arranged on one group of assigned housing sections to form a radial compressive force which is uniformly distributed on the several piston-ring-type elements.

2. A guide vane ring according to claim 1, wherein said approximately axial slots of the piston-ring-type elements are arranged to be uniformly offset with respect to one another in the circumferential direction.

3. A guide vane ring according to claim 1, wherein the piston-ring-type elements and the tensioning element are arranged radially on the inside or radially on the outside of the turbine on the assigned housing sections.

4. A guide vane ring according to claim 1, wherein the one ring and the piston-ring-type elements are made of a ceramic material.

5. A guide vane ring according to claim 1, wherein the guide vanes are manufactured of a ceramic material.

6. A guide vane ring according to claim 1, wherein the piston-ring-type elements are arranged on a supporting ring which is slotted in the axial direction an don which the tensioning element is supported with respect to the corresponding assigned housing sections.

7. A guide vane ring according to claim 1, wherein the compressive force of the tensioning element is generated by a spring element.

8. A guide vane ring according to claim 7, wherein the spring element is a spring ring which is corrugated in the circumferential direction.

9. A guide vane ring according to claim 1, wherein the one ring, which is disposed opposite the piston-ring-type elements, is rigidly connected with the guide vanes via another spring element, and is arranged in the radial direction thermally compatibly on the one group of assigned housing sections.

10. A guide vane ring according to claim 9, wherein the one group of assigned housing sections forms a circumferential groove in which the one ring is held and centered by means of a web and is engaged with a ceramic insulating ring which is connected with the spring element in the circumferential groove.

11. A guide vane ring according to claim 9, wherein the additional spring element is constructed as a metallic wire mesh.

12. A guide vane ring according to claim 11, wherein the spring element and additional spring element are acted upon with cooling air.

13. A guide vane ring according to claim 1, wherein the guide vane ring is arranged in a ring-shaped flow duct, upstream of the moving vanes of a turbine stage, the one and the other ring each being extensions of components of radially outer and radially inner walls of the flow duct.

14. A guide vane ring according to claim 13, wherein the one ring, which is rigidly connected with the guide vanes, is connected directly rigidly with a radially outer or radially inner wall section of the hosing for the flow duct.

* * * * *